US006050373A

United States Patent [19]

Wonka et al.

[11] Patent Number: 6,050,373

[45] **Date of Patent: *Apr. 18, 2000**

[54] SUITCASE WITH VARIABLE CAPACITY

[75] Inventors: Justine Wonka; Franziska Pfeiffer; Nicole Pfeiffer, all of Brunnthal, Germany

[73] Assignee: MP Michael Pfeiffer Design & Marketing GmbH, Hofolding, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/765,444

[22] PCT Filed: Jul. 19, 1995

[86] PCT No.: PCT/EP95/02852

§ 371 Date: Jan. 17, 1997

§ 102(e) Date: Jan. 17, 1997

[87] PCT Pub. No.: WO96/02160

PCT Pub. Date: Feb. 1, 1996

[30] Foreign Application Priority Data

Jul. 19, 1994 [DE] Germany ..... 44 25 553

[51] Int. Cl.[7] ..... A45C 7/00

[52] U.S. Cl. ..... 190/103; 190/109; 190/117; 190/901

[58] Field of Search ..... 190/105, 103, 190/104, 107, 114, 122, 24, 22, 124, 115.18 A, 116; 150/104, 105, 107; 220/9.1, 401; 16/112, 125, 126; 224/610, 611, 612, 614, 615, 616, 617, 618, 619, 620

[56] References Cited

U.S. PATENT DOCUMENTS

| | | | |
|---|---|---|---|
| D. 164,621 | 9/1951 | Bienen | 150/105 X |
| 1,500,029 | 7/1924 | Oliver | 190/116 X |
| 1,950,118 | 3/1934 | Lifton | 150/105 |
| 2,875,868 | 3/1959 | Powell | 150/105 |
| 3,575,226 | 4/1971 | Chapman | 150/105 |
| 3,623,580 | 11/1971 | Toller | 150/105 |
| 4,270,590 | 6/1981 | Marshall | 150/100 |
| 4,503,955 | 3/1985 | Fitzsimmons et al. | 190/107 |
| 4,524,867 | 6/1985 | Klein et al. | 150/105 |
| 4,535,889 | 8/1985 | Terauds | 220/784 X |
| 4,630,717 | 4/1985 | Tong | 190/105 X |
| 4,810,102 | 3/1989 | Norton | 190/116 X |
| 5,082,094 | 1/1992 | Nechushtan et al. . | |
| 5,197,578 | 3/1993 | Van Hooreweder | 190/18 A |

FOREIGN PATENT DOCUMENTS

| | | | |
|---|---|---|---|
| 2233010 | 6/1973 | France | 190/104 |
| 75 41 679 | 4/1976 | Germany . | |
| 77 26 305 | 2/1978 | Germany . | |
| 83 08 483 U | 9/1983 | Germany . | |
| 8415488 | 8/1984 | Germany . | |
| 33 43 068 | 6/1985 | Germany . | |
| 86 22 322 | 2/1988 | Germany . | |
| 89 05 066 | 7/1989 | Germany . | |
| 91 06 252 U | 9/1991 | Germany . | |
| 3-72719 | 7/1991 | Japan . | |

*Primary Examiner*—Stephen P. Garbe
*Assistant Examiner*—Tri M. Mai
*Attorney, Agent, or Firm*—Bacon & Thomas, PLC

[57] ABSTRACT

This invention relates to a case with a variable capacity, comprising a central part (10) which has two stable frame halves (20,30) hinged to one another which serve as supports for a single pair of various size sheet pairs (41,42;51,52) defining the interior of the case, the shells (41,42;51,52) being detachably connected to the frame halves (20,30) of the central part (10), so that shells of different depths may be used together with the same central part. The invention also relates to a set of cases, comprising a central part and two or several pairs of shells.

14 Claims, 6 Drawing Sheets

SUITCASE WITH VARIABLE CAPACITY

BACKGROUND OF THE INVENTION

This invention relates to a case with a variable capacity, comprising a central part which has two stable frame halves hinged to one another which serve as supports for a single shell pair forming the interior of the case.

RELATED ART

In conventional cases, for example suitcases or travel cases, the volume of the case interior is mostly constant. Therefore, for different volumes of clothes to be packed, different cases are required. For a business trip, for example, lasting only a few days, a smaller case is necessary than for a holiday lasting several weeks. The costs of purchasing several cases of different sizes is high and the storage requirements considerable.

Various prior art cases are known, of which the inside volume is variable, so that a case is provided which is able to accommodate different quantities. A case is, for example, known from the German registered design GM 77 26 305 which may be enlarged gradually up to double the volume, as required. For this purpose, in particular deep folds are provided in the cover and in the bottom part of the case. The German registered design GM 75 41 679 relates to a case with two firm shells and a flexible intermediate part.

Both solutions, however, have the disadvantage that the folds and the flexible intermediate part affect the stability of the case unfavourably. The fold and the flexible intermediate part reduce the overall stability of the case. Stresses from outside may cause the case to become deformed. This could lead to damage to the case, itself, or to its contents.

DE 33 43 068 discloses a small suitcase of a modular construction. Here, cover parts are provided on either side of a central part. The cover parts may be detachably connected to the central part. This makes it possible to replace a cover part of a certain depth by a cover part of a different depth. The cover parts are connected to the central part via hinges. Opening and closing the case places a great stress on the hinges. When hinges are constructed as detachable connections, they normally produce a weak spot which reduces the service life of the case.

The German registered design G 83 08 483 is a case which has two shells hinged to one another and enclosing the interior, which form a lockable stable frame as support. Here, the shells are expandable so that the capacity of the interior may be adapted to the relevant requirements. The shells consist of a resilient material which reduces the stability of the case.

This invention has the object of providing a case with a volume which may be adapted to the relevant requirements but which is also stable and easily operated.

BRIEF SUMMARY OF THE INVENTION

This object is achieved by a case of a variable capacity comprising a central part which consists of two stable frame halves hinged to one another. The frame halves serve as supports for a single pair of various size shell pairs which, together with the frame halves, define the interior of the case. Normally, the frame has a rectangular general shape, each frame half providing a grip side, a hinge side positioned opposite the grip side and two opposing side sections. The frame elements may be integrally formed. According to the invention, the shell pairs are detachably connected to the frame halves of the central part.

In this way, it is possible for shells of varying depth to be used in combination with the same central part. Thus the case volume may be adapted to the volume of the contents. The shells, normally consisting of a rigid plastic material, form, together with the central part consisting of a light metal or a rigid plastic material, a stable case. When the case is not in use, the shells of different depths may nest inside one another. Thus, a case, according to the invention, clearly requires less storage space than several conventional cases with different internal volumes.

Advantageously, each frame half provides means for at least one three-point connection for each half of a shell pair. A detachable three-point fixing of each shell in the associated frame half may, for example, be realised by a snap connection. It is important here that the shells are of sufficient rigidity in order to produce a stable interior together with the frame halves of the central part.

Preferably, each frame half has a groove on the inside of the hinge side in which an edge of a respective shell engages. On the opposite grip side, the inside has at least one means for fixing the respective shell. When the shells are frequently exchanged it may occur that the above snap connection fails because of wear and tear of the material. Therefore, for reasons of stability, the use of other mechanical means for fixing the shells in the central part are preferred.

The shells have, advantageously, a circumferential edge which abuts an inner circumferential edge of the associated frame half and snaps in behind beads arranged parallel to the circumferential edge in the associated frame half. These snap-in beads secure the shells in their position of abutment. This type of connection makes it possible for the shells to be exchanged quickly and the case is thus easy to operate.

The abutment edge has, preferably, a groove into which a projection may be placed which is provided on the seam of the shell members.

Advantageously, the means for fixing said shell in the associated shell half may be one of the following or a combination of at least two thereof:

Springs, hinges, a cam strip, a corner-clamping device, a rocker, a bolt and/or a slide. Preferred means for fixing the relevant shell in the associated frame half are illustrated in the enclosed drawing.

A handle is, preferably, hinged to the central part. It is also possible to arrange a handle on each shell. In this case, however, the handles must be arranged on the shells in such a way that, when assembled, they form a single handle of the case.

It is also advantageous if a recess is provided in at least one shell which may be closed by a pivotable cover which aligns with the outer contour of the shell. The recess serves to accommodate objects which should be easily accessible when the case is in use, for example papers, keys, purse, glasses case, etc.

A preferred embodiment of the central part of the case in accordance with the invention has means for fixing a shoulder strap. These means are preferably provided in the side parts of the frame half. Advantageously, the shoulder strap is secured to one side part in the upper frame half and to the opposite side part in the lower frame half. Thus, in the event of an accidental opening of the lock when the case is being carried, the halves are still held together by the shoulder strap and cannot open completely.

Advantageously, the fixing means in each side part comprise at least one slide rail running parallel to the side part. This slide rail has a stop in its upper end close to the grip side and is covered over one part of its width by at least one protruding fin formed by the surface of the side part so that complementary catch means provided on one buckle of the shoulder strap may engage. The fixing means do not project from the surface of the central part and do not affect the overall visual impression of the case in accordance with the invention. A slide rail may be provided centrally on each side part into which a pin arranged on the buckle of the shoulder strap may be pressed so as to be displaceable in the slide rail. However, each side part has, preferably, two parallel slide rails which are preferably arranged on the two edges of a side part. The slide rail then forms an undercut groove and is virtually invisible from outside, because of the projecting fin.

The buckle or the catch means, thereof, may have a certain elasticity so that, under the effect of force, they are able to engage with the fixing means of the side strip. Preferably, however, in order to fix the buckle to the case, there is a recess in the fin on the lower end of the slide rail, remote from the grip side, in order to attach the catch means. When the catch means are attached, the buckle may be moved upwardly in the slide rail in the direction of the stop.

Preferably, there are catch means for the buckle of the shoulder strap close to the stop of the slide rail. The catch means ensure a secure support for the buckle during carrying and prevent the buckle from dropping downwards in the slide rail when the strap is unstressed. The catch means, are, advantageously in the form of projections of the slide rail. The dimensions of these projections are such that the buckle may be pulled over these projections by exerting some force, but that the natural weight of the buckle and of the shoulder strap is not sufficient to allow the buckle to drop down over the projection. The spacing of the projections from the stop is preferably such that the catch means of the buckle are firmly positioned with the necessary play.

The catch means of the buckle are preferably metal tongues which come into engagement with the slide rail. However, the tongues may also be of another material, for example of plastic, and may also be in the form of nubs in other embodiments of the buckle. The buckle, itself, may also be made of a plastic material of metal.

Because of their strength, shells made of hard plastic material are preferred as case shells. In other embodiments of the invention, however, the shells are made of soft material which, for example, consist of tear-resistant plastic or natural fibre tissues. Here, it is important that the edge region of each shell which engages in the central part is of a relatively rigid construction and is in the same shape of the hard and soft shells.

In a preferred embodiment, the exchangeable shells have feet within the region of the lower corners, which are, preferably, in the form of hard rubber or plastic rollers.

This invention also relates to sets of cases comprising a central part of the above kind as well as at least two pairs of shells, each having a different depth. Such a set of cases has an advantage over two conventional cases. Quicker production cycles and easy assembly ensures a saving of costs. Cases in accordance with the invention may be produced in different sizes. The principle of the invention may be applied to any type of case. The fact that the shells may be exchanged also provides new possibilities for the individual colour designs of these cases.

A set of cases may, for example, consist of pairs of both hard and soft shells.

Embodiments of the case in accordance with the invention are hereinafter more fully explained by way of example with reference to the enclosed drawing. Shown are:

FIG. 1 a perspective partial view of the case in accordance with the invention, in which a shell is being inserted into the frame of the central part;

FIG. 2 the central part of the case having a flexible handle without hinges;

FIG. 3 the central part of the case without shells;

FIG. 4 a section through the grip side of the central part of the case in accordance with the invention, i.e. substantially a section along line IV—IV of FIG. 3. Here, in FIG. 4, the frame halves are closed, which are open in FIG. 3;

FIG. 5–8 show preferred embodiments of the means for fixing one of the shells forming the interior of the case in the associated frame half;

FIG. 9 a preferred embodiment of the strap fixing means provided in the frame half;

FIG. 10 a side view of the strap fixing means as shown in FIG. 6;

FIG. 11 the buckle of the shoulder strap adapted to the strap fixing means shown in FIGS. 7 and 8;

DETAILED DESCRIPTION OF THE PREFERRED EMBODIMENT OF THE INVENTION

Figure 1:
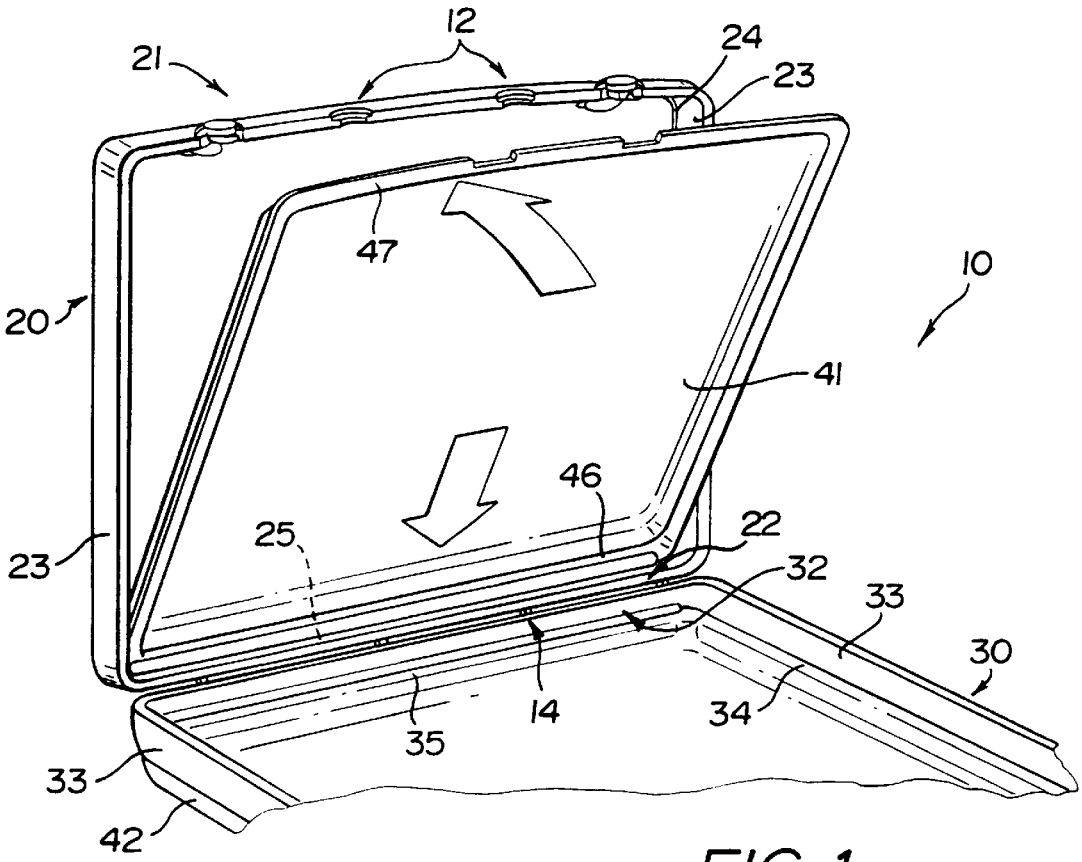
Figure 3:
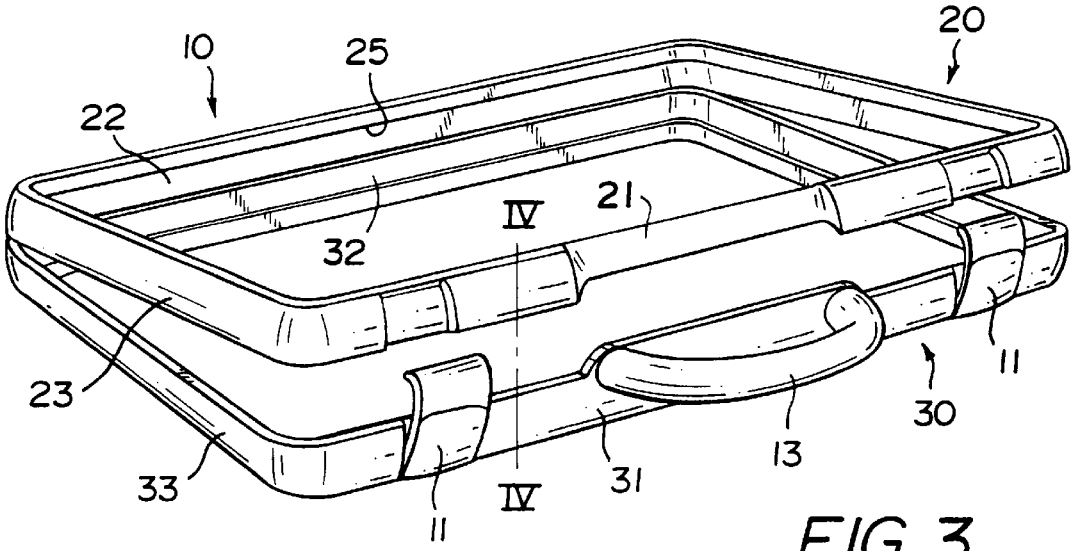

A central part 10 shown in FIGS. 1 and 3 is formed by two frame halves 20,30. Each frame half has a grip side 21,31, a hinge side 22,32 and two side parts 23,33. The two frame halves 20,30 are hinged to one another by hinges 14. On the sides of the frame half 20,30, which are positioned opposite the hinges 14, there are locking means 11. Between the locking means in the frame halves 20,30, there are recesses 12 for receiving a handle 13 (not shown in FIG. 1). The frame halves 20,30 each have a circumferential edge 24,34. Furthermore, there are grooves or beads 25, 35, 78 on the inside hinge side 22,32 of the frame halves 20,30, parallel to the hinges 14.

Figure 2:
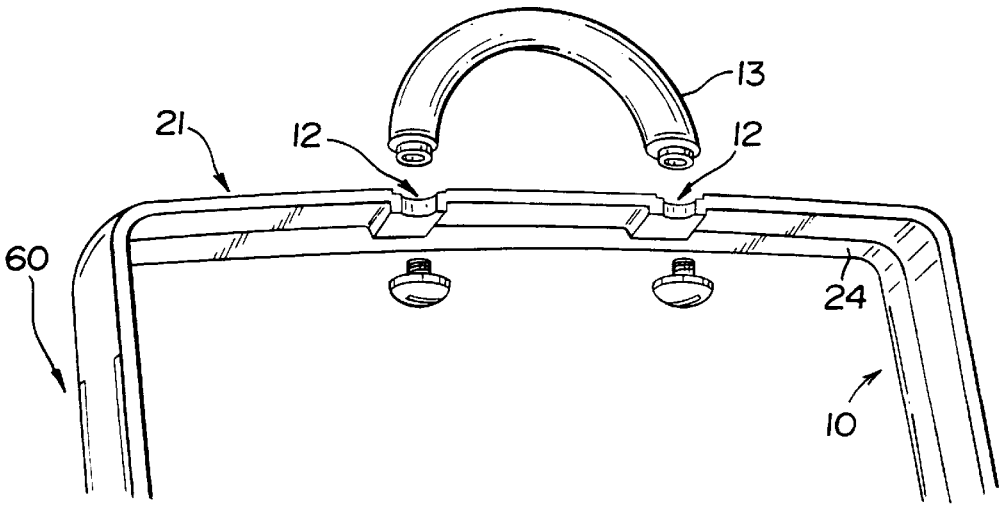

An advantageous construction of a handle 13 and a handle attachment without hinges in the central part 10 is shown in FIG. 2. Advantageously, the handle 13 is made of a tube-like, flexible material whose two ends are secured to the central part 10. The tube-like handle may contain a reinforced insert, for example a metal cable or a chain. This handle has the advantage that it is very simple to manufacture and easy to mount. It has no hinges and can nevertheless be tilted in the same way as a hinged handle. However, it is obvious that instead of the handle without a hinge, a conventional case handle known per se may also be used.

The case interior shown in FIG. 1 is formed by two flat shells 41,42 which may be placed into the central part 10 so as to be interchangeable with other shell pairs. The shells 41,42 each have a circumferential edge configuration 47 which abuts the circumferential edge 24 of the frame half 20,30. The edge 46 respectively engages behind the beads 25,35,78 on the hinge side 22,32 of the frame halves 20,30.

Figure 4:
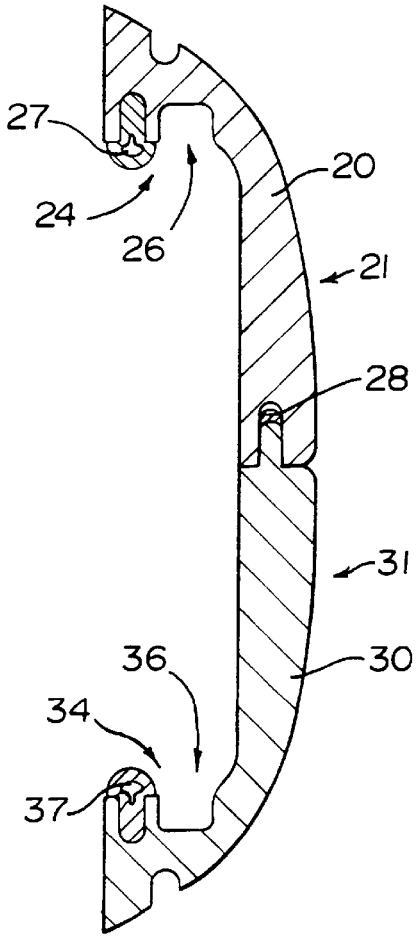

A particularly advantageous construction of the cross section of the frame halves 20,30 is shown in FIG. 4. Here, the circumferential edge 24,34 is not only in the form of a stop, but it has a groove 26,36, in which a projection of the circumferential edge 47 of the shells 41,42 may engage, said projection being complimentary to the shape of the groove. This ensures that the grip side 21,31 cannot become detached from the upper edge of the shells 41,42 when the filled cased is lifted, but that the central part 10 and the shells 41,42 are connected to each other in the vertical direction so as to be dimensionally stable. In a second circumferential recess, there is a seal 27,37. When the shells 41,42 are inserted into the frame halves 20,30 the outer face of each shell is pressed against the seal 27,37 so that no humidity may enter the case from outside. A corresponding water-tight seal in the form of a sealing strip 28 is provided in the closing region of the frame halves.

On the grip side 21,31 of the frame halves 20,30, there are means for fixing the shells 41,42 in the associated frame half 20,30.

FIGS. 5–8 show embodiments of those fastener means which ensure that the typical projection of edge 47 of a shell half 41 abuts and is detachably connected to a circumferential edge 24,34 of frame halves 20,30. FIGS. 5*a* and 5*b* depict schematically a sliding catch 74 carried by frame half 20 biased leftward (as shown) against edge 47 of a shell half 41 by means of a leaf type compression spring 73. FIG. 5*b* shows the catch 74 displaced rightward in a released position deflecting spring 73 that tends to return catch 74 to the position shown in FIG. 5*a*.

Figure 6A:
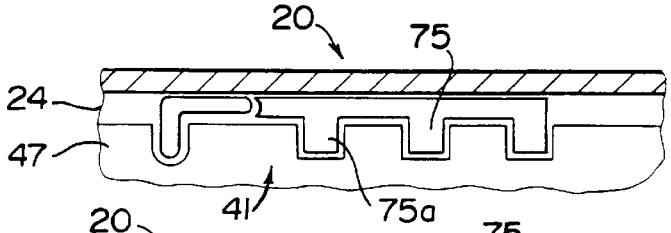
Figure 6B:
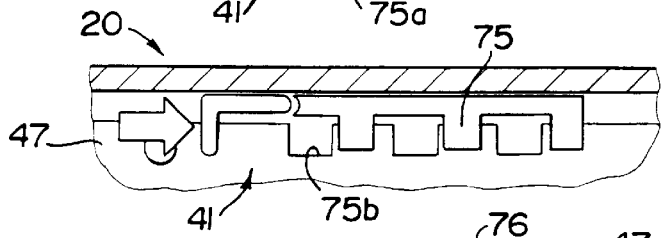

FIGS. 6*a* and 6*b*, depict a sliding cam type catch 75 having projecting teeth 75*a* that cooperate with corresponding openings or grooves 75*b* in shell half edge 47 to retain the edge 47 in contact with the circumferential edge 24 of frame half 20. In operation, FIG. 6*a* shows the catch in a released position whereby the shell edge 47 can be separated from the circumferential edge 24 of frame 20 because the projections 75*a* are aligned with the openings 75*b*. In FIG. 6*b*, the shell half 47 is retained against the circumferential edge 24 by reason of the interference between the projections 75*a* and the portions of the shell edge 47 that extend between the openings 75*b*.

Figure 5A:
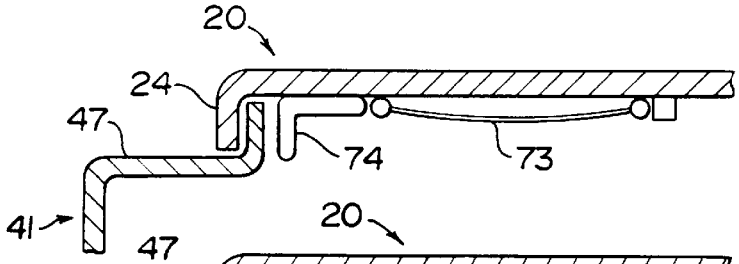
Figure 5B:
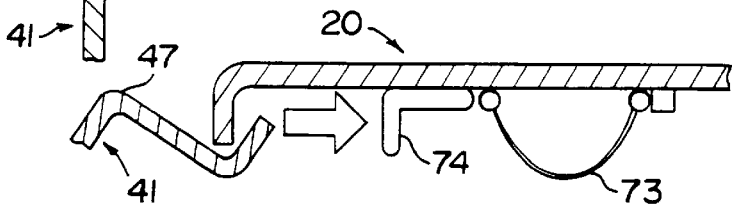
Figure 7A:
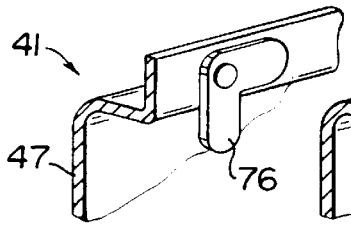
Figure 7B:
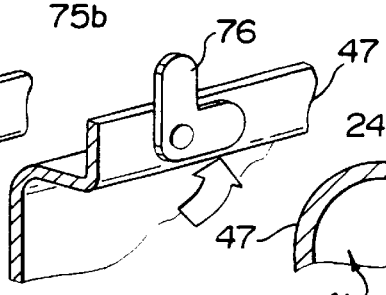
Figure 7C:
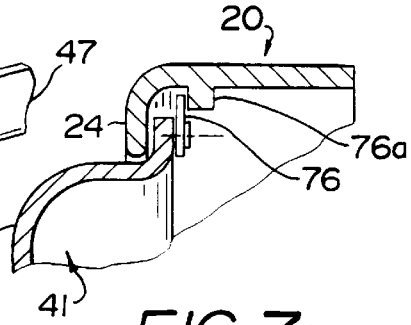

It will be noted that the fastener devices illustrated in FIGS. 5*a*, 5*b*, 5*a* and 6*b* all remain connected to the frame half both in the locked and released positions irrespective of whether or not the shell half edge 47 is positioned against the circumferential edge 24 of the frame 20. In accordance with FIGS. 7*a*, 7*b* and 7*c*, a rotatable catch 76 mounted on the edge 47 of the shell half 41 is rotatable between locked and released positions so as to selectively cooperate with an abutment 76*a* carried by the frame half 20 to retain shell half 47 against edge 24 of frame 20 or to release same from the frame half. FIG. 7*c* shows the rotatable latch 76 in a locked position whereby the edge 47 of shell half 41 is retained against circumferential edge 24 of frame 20. Rotation of the latch 76 to the position shown in FIG. 7*a* obviously releases the latch 76 from the abutment 76*a* to permit separation of the shell half 41 from the edge 24 of frame 20.

Figure 8:
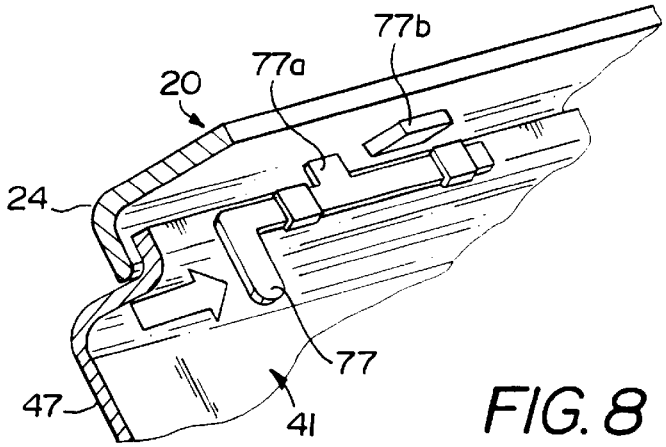

FIG. 8 illustrates a sliding latch 77 carried by shell half 41 that includes a projection 77*a* which cooperates with abutment 77*b* carried by the frame half 20 to selectively secure edge 47 of shell half 41 against circumferential edge 24 of frame half 20. In operation, motion of the latch 77 to the right as depicted by the illustrated arrow engages projection 77*a* behind abutment 77*b* to prevent separation between the edge 47 of shell 41 and edge 24 of frame 20. Reverse sliding of the latch 77, of course, releases the projection 77*a* from the abutment 77*b*, thereby permitting withdrawal of the edge 47 of the shell half 41 from the edge 24 of frame 20.

In accordance with the embodiments illustrated in FIGS. 5*a*–8, the fastener means retaining the shell halves against the frames 20,30, are carried by either of the shell half and the frame and always remain with the respective shell half or frame irrespective of the released or secured position of the fastening device and irrespective of whether or not the shell halves and frame halves are connected together or separated.

Figure 9:
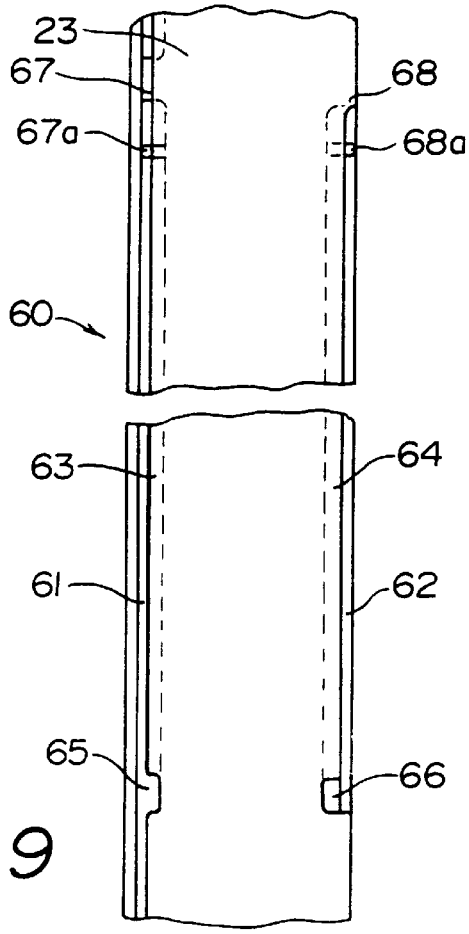
Figure 10:
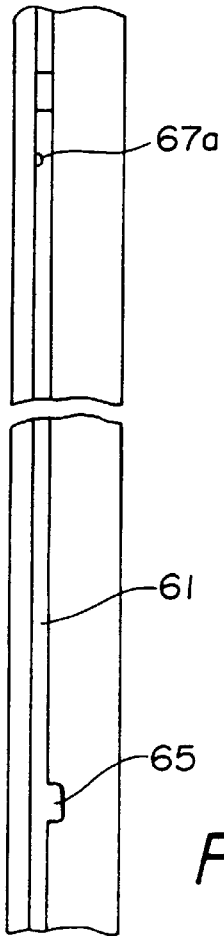
Figure 11:
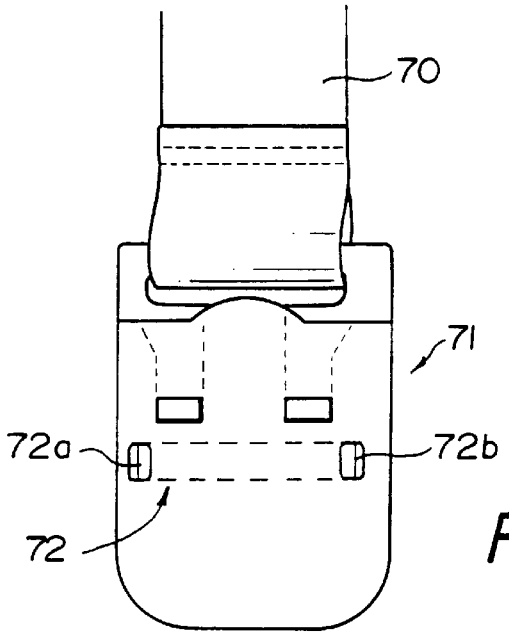

FIG. 9 shows a preferred embodiment of the strap fixing means in accordance with the invention. Two slide rails 61,62, in the form of an undercut groove, are provided in the frame, at the edge of a side part 23 of the frame half 20. Each slide rail is covered by a protruding fin 63,64 so that the fixing means 60 do not project from the surface of the central part 10. The fixing means 60, themselves, are hardly visible. Rather, the visible part of the slide rail 61,62 looks like decorative strips of the central part. At the upper end facing the grip side, there is a stop 67,68 and locking means 67*a*,68*a* in the form of a projection in the slide rail. In the lower region of the slide rail, there are recesses 65,66 in the fin 63,64. FIG. 10 shows the side view of the slide rail as shown in FIG. 9.

FIG. 9 shows one end of a shoulder strap 70 with a buckle 71 which may cooperate with the fixing means 60. Catch means 72 are arranged on the buckle which may be placed into recesses 65,66 provided on the fin 63,64. After insertion, the buckle is pushed upwards in the direction of the lock means. After locking, the buckle 71 is firmly anchored in the upper part of the slide rail 61,62. In this embodiment the catch means 72 are in the form of L-shaped tongues 72*a*,72*b*. These tongues engage in undercut grooves 61, 62 of the slide rails and retain the buckle 71 on the rails.

Figure 12:
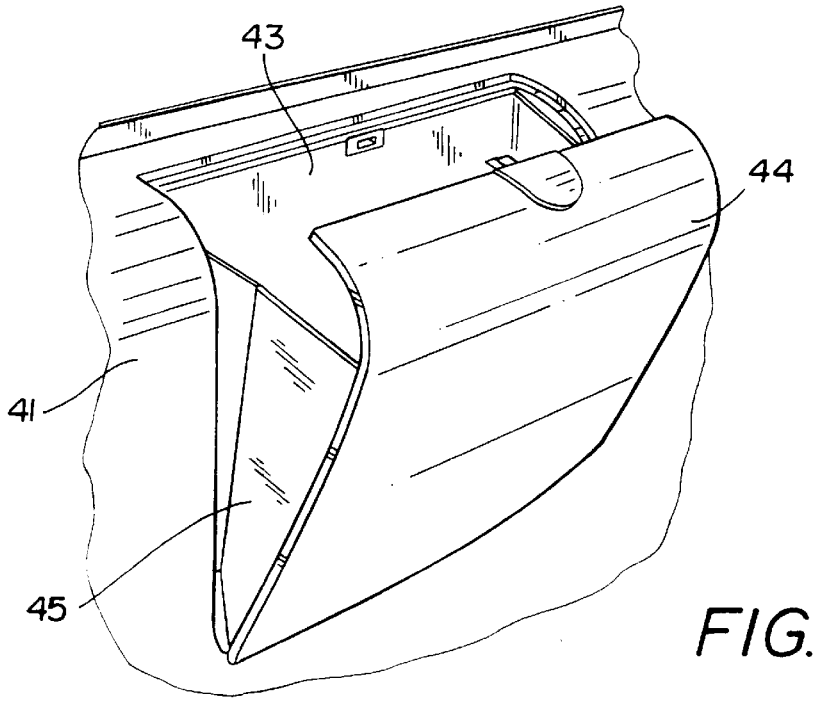
FIG. 12 shows a section of one of the shells forming the case interior and having an inner pocket which may be flipped open.

FIG. 12 shows a recess 43 in one of the shells 41,42. The recess 43 may be closed by a cover 44. Between the recess 43 and the cover 44, there is a pocket 45 which has been glued in. The pocket 45 serves to receive small items.

Figure 13:
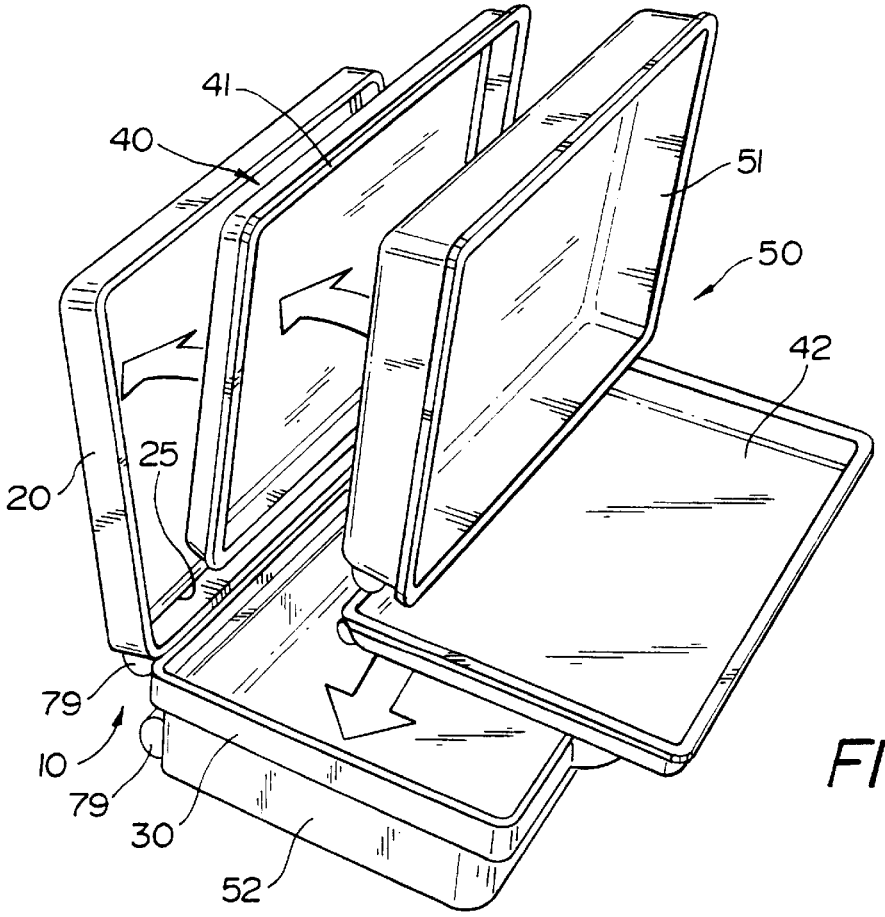
FIG. 13 shows a three-dimensional view of a set of cases in accordance with the invention.

FIG. 13 shows a set of cases formed by two frame halves 20,30 and four shells (2 pairs) 41,42,51,52. The shell pair 41,42 form a flat set 40 and are of a smaller depth than the shell pair 51,52 which form a deep set 50. For storage the shells 41,42,51,52 may be placed inside one another and thus clearly require less storage space than two complete cases.

Figure 14:
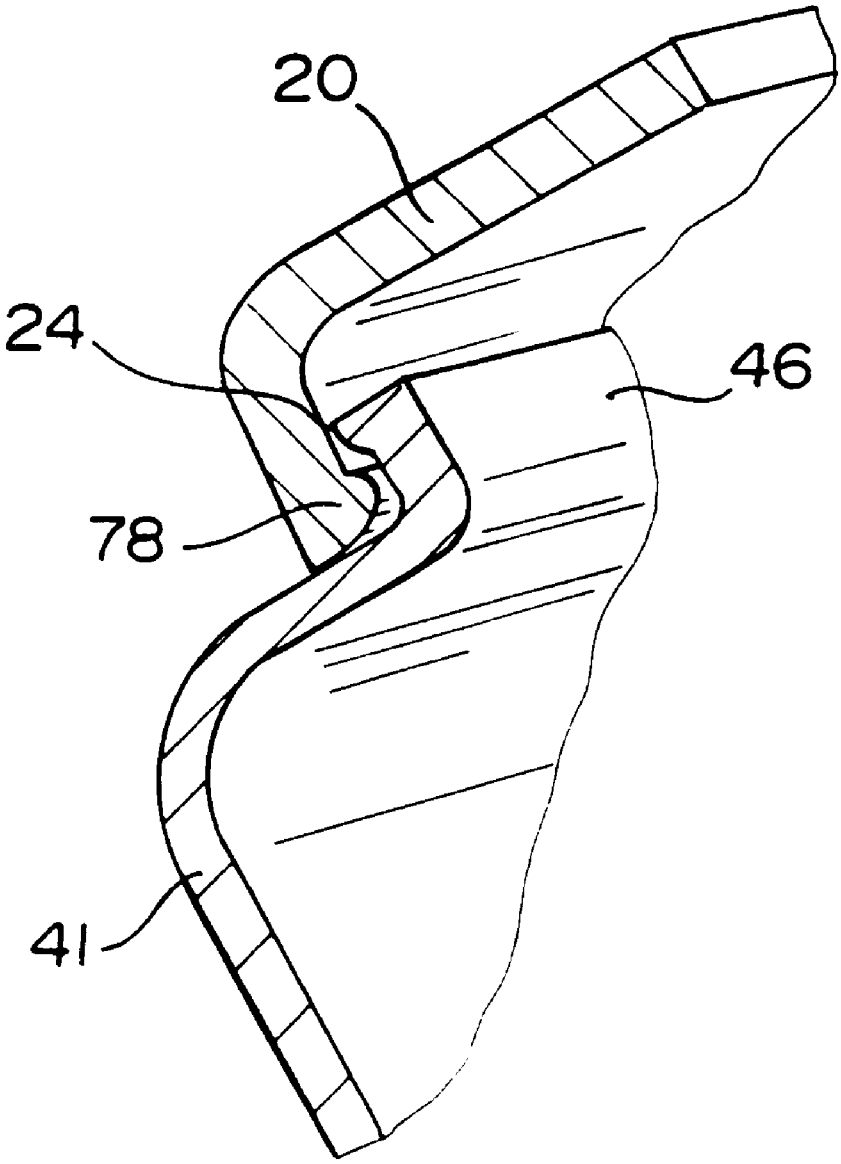
FIG. 14 shows an edge of a shell connected to a frame bead.

FIG. 14 shows how an edge detail 46 of a shell section 41 engages a bead 78 of a frame edge 24.

When using the set in accordance with the invention, the procedure is as follows:

Firstly, the pair of shells best suited to accommodate the items to be packed is chosen; then the edge configuration 46 of the selected shell is brought into engagement behind the bead 25,35; 78 the respective shell is then pressed into the associated frame half so that the circumferential edge 47 rests on the circumferential edge 24,34 or the projection of the edge 47 engages in the groove 26,36 of the frame halves. Finally, the means for fixing the shells in the associated frame half are placed into their blocking position and the case in accordance with the invention is ready for use.

Within the region of their lower corners the shells 41,42, 51,52 have feet in the form of rollers 79, (FIG. 13) which rest in a semi-spherical tray moulded onto the shells. The rollers are preferably made of hard rubber or plastic material. They have the advantage over conventional feet for cases that they do not cause any scratching.

We claim:

1. A case with a variable capacity, including a central part (10) comprising two stable frame halves (20,30) each formed in a single continuous piece and multiple shell pairs (41,42;51,52) having varying capacities, said frame halves being hinged to each other and serving as supports for a single shell pair only of said shell pairs at a time defining the capacity of the case, each frame half (20,30) having a grip side (21,31), a hinge side (22,32) positioned opposite the grip side, and two opposing side parts (23,33), wherein either of said shell pairs and frame halves carries a securing device detachably securing together a respective shell and frame half, said fastener device remaining carried by a respective shell and frame half irrespective of whether the securing device is in a released or securing condition, whereby single shell pairs of said multiple shell pairs may be selectively removably secured to said frame halves of said central part; and wherein said hinge side has an inside area, each shell has an edge portion and each frame half (20,30) has a groove (25,35) on the inside area of the hinge side (22,32) extending parallel with the hinge side of the frame half in which an edge portion (46) of a respective shell (41,42;51,52) extending along the length of the edge portion engages, and wherein part of said securing device is located on the grip side (21,31) of each frame half.

2. A case according to claim 1, wherein said securing device comprises means for connecting an individual shell (41,42;51,52) of said shell pairs with each associated frame half (20,30) at at least three points.

3. A case according to claim 1, wherein said securing device is selected from the group consisting of a spring biased catch (74), a cam projection and openings **(75,75*a*), a sliding latch (77) and a pivoting catch (76)**.

4. A case according to claim 1 wherein a recess (43) is provided in at least one shell of each shell pair (41,42;51,52) said recess being closable by a pivotable cover (44) which substantially aligns with an outer contour of the at least one shell (41,42;51,52).

5. A case according to claim 1, wherein a handle (13) without hinges and made of a tube-like, flexible material is detachably secured to the central part (10).

6. A case according to claim 1, wherein means (60) for fixing a shoulder strap (70) are provided in the side parts (23,33) of the frame halves (20,30).

7. A case according to claim 1, wherein said shells (41,42;51,52) of said shell pairs are selected from the group consisting of hard and soft shells.

8. A case according to claim 1, wherein said shells (41,42;51,52) of said shell pairs have roller caster feet (79) within a region of respective lower corners thereof, and which are mounted in integrally moulded, semi-spherical trays.

9. A case according to claim 6, wherein said means (60) for fixing a shoulder strap (70) in each side part (23,33) each comprises at least one side rail (61,62) which runs parallel to the side part and is recessed in the side part, the slide rail (60,62) having a stop (67,68) at its upper end close to the grip side (21,31) and being covered over one part of its width by at least one projecting fin (63,64) formed by a surface of the side part to accommodate complementary means (72) for latching into said slide rail, said means being arranged on a buckle (71) of the shoulder strap (70).

10. A case according to claim 9, wherein, in order to mount the buckle (71) on the case, a recess (65,66) used for the insertion of said latching means (72) is provided in the respective fin (63,64) of a side rail located at a lower end of the slide rail (61,62), and remote from the grip side (21,31).

11. A case according to claim 9 including locking means **(67*a*,68*a*) for the buckle (71) of the shoulder strap (70) located closest to the stop (67,68)**.

12. A case according to claim 9, wherein said latching means (72) of the buckle (71) are formed as metal tongues **(72*a*,72*b*)**.

13. A case according to claim 1, wherein the shell pairs are of varying depth.

14. A case with a variable capacity, including a central part (10) comprising two stable frame halves (20,30) each formed in a single continuous piece and multiple shell pairs (41,42;51,52) having varying capacities, said frame halves being hinged to each other and serving as supports for a single shell pair only of said shell pairs at a time defining the capacity of the case, each frame half (20,30) having a grip side (21,31), a hinge side (22,32) positioned opposite the grip side, and two opposing side parts (23,33), wherein either of said shell pairs and frame halves carries a securing device detachably securing together a respective shell and frame half, said fastener device remaining carried by a respective shell and frame half irrespective of whether the securing device is in a released or securing condition, whereby single shell pairs of said multiple shell pairs may be selectively removably secured to said frame halves of said central part wherein each of said frame halves is provided with fixing means for detachably connecting one shell of a shell pair (41,42;51,52) with an associated frame half (20, 30) of said central part (10), so that said shell pairs can be interchangeably connected to and used in combination with said central part (10); and wherein the shells of each shell pair (41,42;51,52) each have a circumferential edge portion (47) which abuts an inner circumferential edge of the associated frame half (20,30) and is configured to snap in behind beads (78) arranged parallel to a circumferential edge (24,34) in the associated frame half (20,30) said beads comprising a portion of said securing device.

* * * * *